US011746788B2

(12) United States Patent
Iguchi

(10) Patent No.: US 11,746,788 B2
(45) Date of Patent: Sep. 5, 2023

(54) VACUUM PUMP HAVING A LIQUID COOLED VIBRATION MONITORING DEVICE MOUNTED THEREON

(71) Applicant: Seiko Epson Corporation, Tokyo (JP)

(72) Inventor: Shuichi Iguchi, Ina (JP)

(73) Assignee: SEIKO EPSON CORPORATION

( * ) Notice: Subject to any disclaimer, the term of this patent is extended or adjusted under 35 U.S.C. 154(b) by 91 days.

(21) Appl. No.: 17/409,880

(22) Filed: Aug. 24, 2021

(65) Prior Publication Data

US 2022/0065253 A1 Mar. 3, 2022

(30) Foreign Application Priority Data

Aug. 25, 2020 (JP) ..... 2020-141531
Jun. 16, 2021 (JP) ..... 2021-099986

(51) Int. Cl.
*F04C 29/04* (2006.01)
*F04C 28/28* (2006.01)
*F04C 18/16* (2006.01)

(52) U.S. Cl.
CPC ..... *F04C 29/04* (2013.01); *F04C 28/28* (2013.01); *F04C 18/16* (2013.01); *F04C 2220/10* (2013.01); *F04C 2240/30* (2013.01); *F04C 2240/81* (2013.01); *F04C 2270/12* (2013.01)

(58) Field of Classification Search
CPC ..... F04C 29/042; F04C 29/045; F04C 29/047
See application file for complete search history.

(56) References Cited

U.S. PATENT DOCUMENTS

2018/0170783 A1* 6/2018 Baxter ..... C02F 11/125
2022/0412357 A1* 12/2022 Mikulic ..... F04C 28/12

FOREIGN PATENT DOCUMENTS

CN 207982885 U * 10/2018 ..... B23Q 5/04
JP 2000-074080 A 3/2000

OTHER PUBLICATIONS

English translation of CN207982885 by PE2E Jan. 10, 2023.*

* cited by examiner

*Primary Examiner* — Deming Wan
(74) *Attorney, Agent, or Firm* — Harness, Dickey & Pierce, P.L.C.

(57) ABSTRACT

A vacuum pump includes a pump rotor, a housing configured to house the pump rotor, and a monitoring device attached to the housing and configured to detect vibration of the housing. The housing includes first channels for causing a coolant to flow to a portion opposed to the monitoring device.

5 Claims, 17 Drawing Sheets

VACUUM PUMP HAVING A LIQUID COOLED VIBRATION MONITORING DEVICE MOUNTED THEREON

The present application is based on, and claims priority from JP Application Serial Number 2020-141531, filed Aug. 25, 2020 and JP Application Serial Number 2021-099986, filed Jun. 16, 2021, the disclosure of which are hereby incorporated by reference herein in its entirety.

BACKGROUND

1. Technical Field

The present disclosure relates to a device.

2. Related Art

JP-A-2000-74080 (Patent Literature 1) discloses a vacuum pump that houses a motor. According to Patent Literature 1, a rotating shaft of the motor is fixed by a pair of bearings. A rotary blade is set in the rotating shaft. The motor rotates the rotary blade to thereby function as a pump. When balls of the bearings are deteriorated, the bearings vibrate. According to Patent Literature 1, by attenuating the vibration of the bearings in a rotating speed region of a natural frequency of the bearings, the vacuum pump can reduce a tilt of a main shaft and positional deviation in an axial direction. For predictive maintenance of such a vacuum pump, it is conceivable to attach a monitoring device mounted with a sensor unit.

However, it is not easy to attach the monitoring device to a vibration source in the vacuum pump or the like. More specifically, since a portion near the bearings, which are vibration sources, has high temperature, sensing accuracy of the monitoring device is deteriorated. When the monitoring device is set in a portion far from the vibration sources, the temperature of the monitoring device decreases. However, since the vibration transmitted from the bearings is attenuated, vibration detection accuracy is deteriorated. Therefore, there has been a demand for a structure that can prevent a temperature rise of the monitoring device even in a place where the temperature of a housing rises near the vibration sources.

SUMMARY

A device includes: a movable body; a housing configured to house the movable body; and a monitoring device attached to the housing and configured to detect vibration of the housing. The housing includes first channels for causing a coolant to flow to overlap the monitoring device in a plan view from a direction perpendicular to an attachment surface for the monitoring device.

DESCRIPTION OF EXEMPLARY EMBODIMENTS

First Embodiment

Figure 1:
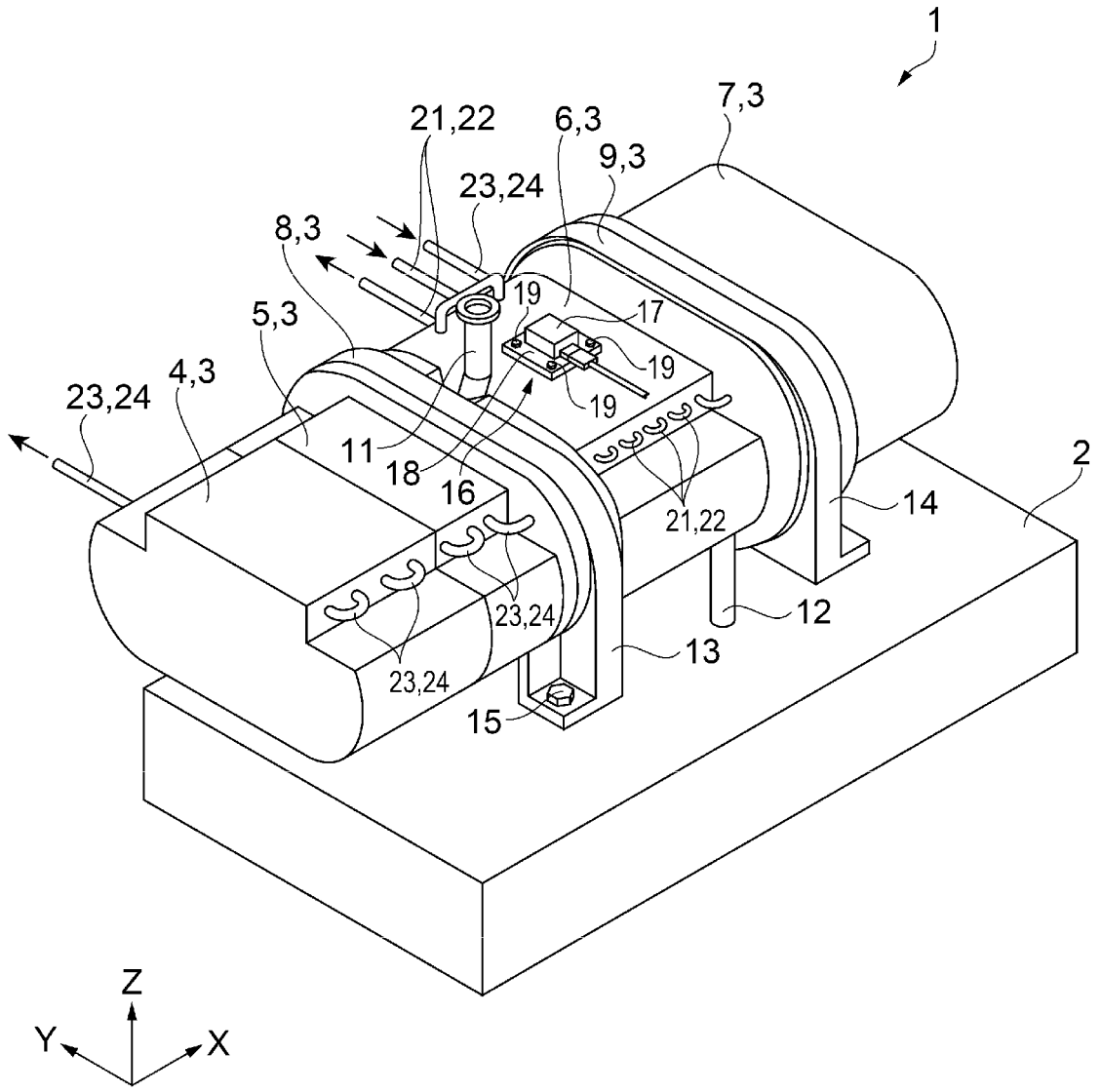
FIG. 1 is a schematic perspective view showing the configuration of a vacuum pump according to a first embodiment.

In a first embodiment, a characteristic example of a vacuum pump attached with a monitoring device is explained. As shown in FIG. 1, a vacuum pump 1 functioning as a device is set on a base 2. The vacuum pump 1 has a columnar shape substantially elliptical in cross section. The longitudinal direction of the vacuum pump 1 is represented as an X direction. The major axis direction of the ellipse is represented as a Y direction and the minor axis direction of the ellipse is represented as a Z direction.

The vacuum pump 1 includes a housing 3. The housing 3 includes a motor case 4, a connecting section 5, a pump case 6, and a gear case 7 disposed from a −X-direction side toward a +X-direction side. The housing 3 includes a first sidewall 8 between the connecting section 5 and the pump case 6. The housing 3 includes a second sidewall 9 between the pump case 6 and the gear case 7.

An intake pipe 11 is coupled to the surface on a +Z-direction side of the pump case 6. An exhaust pipe 12 is coupled to the surface on a −Z-direction side of the pump case 6.

The first sidewall 8 includes a first leg section 13 and a second leg section on the base 2 side. The first leg section 13 is disposed on a −Y-direction side and the second leg section is disposed on a +Y-direction side. The second sidewall 9 includes a third leg section 14 and a fourth leg section on the base 2 side. The third leg section 14 is disposed on the −Y-direction side and the fourth leg section is disposed on the +Y-direction side. The first leg section 13 to the fourth leg section are fastened to the base 2 by first bolts 15.

A monitoring device 16 is attached to the pump case 6, which is a part of the housing 3. The monitoring device 16 detects vibration of the housing 3. The monitoring device 16 includes a sensor unit 17 that detects the vibration of the housing 3. The sensor unit 17 includes an inertial sensor. Further, the monitoring device 16 includes a plate 18 for attachment of the sensor unit 17. Further, the plate 18 is fixed to the pump case 6 by second bolts 19. When the sensor unit 17 detects vibrations in three axial directions orthogonal to one another, a posture of the sensor unit 17 is not limited. The monitoring device 16 may output a waveform of vibration or may determine amplitude of the vibration and output a warning signal.

The pump case 6 includes first pipes 22 forming first channels 21. The motor case 4, the connecting section 5, and the pump case 6 include second pipes 24 forming second channels 23.

Figure 2:
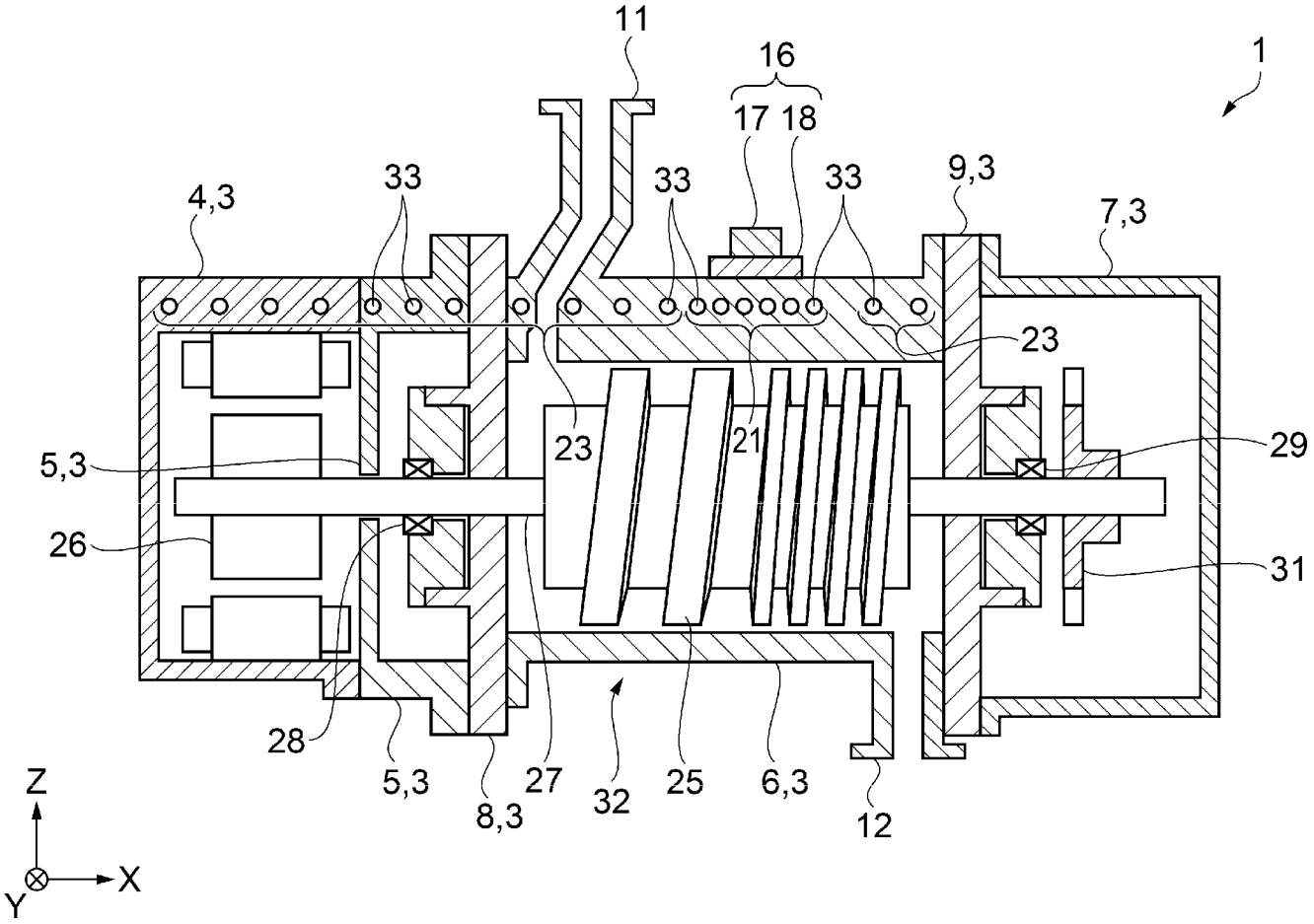
FIG. 2 is a schematic side sectional view showing the internal structure of the vacuum pump.
Figure 3:
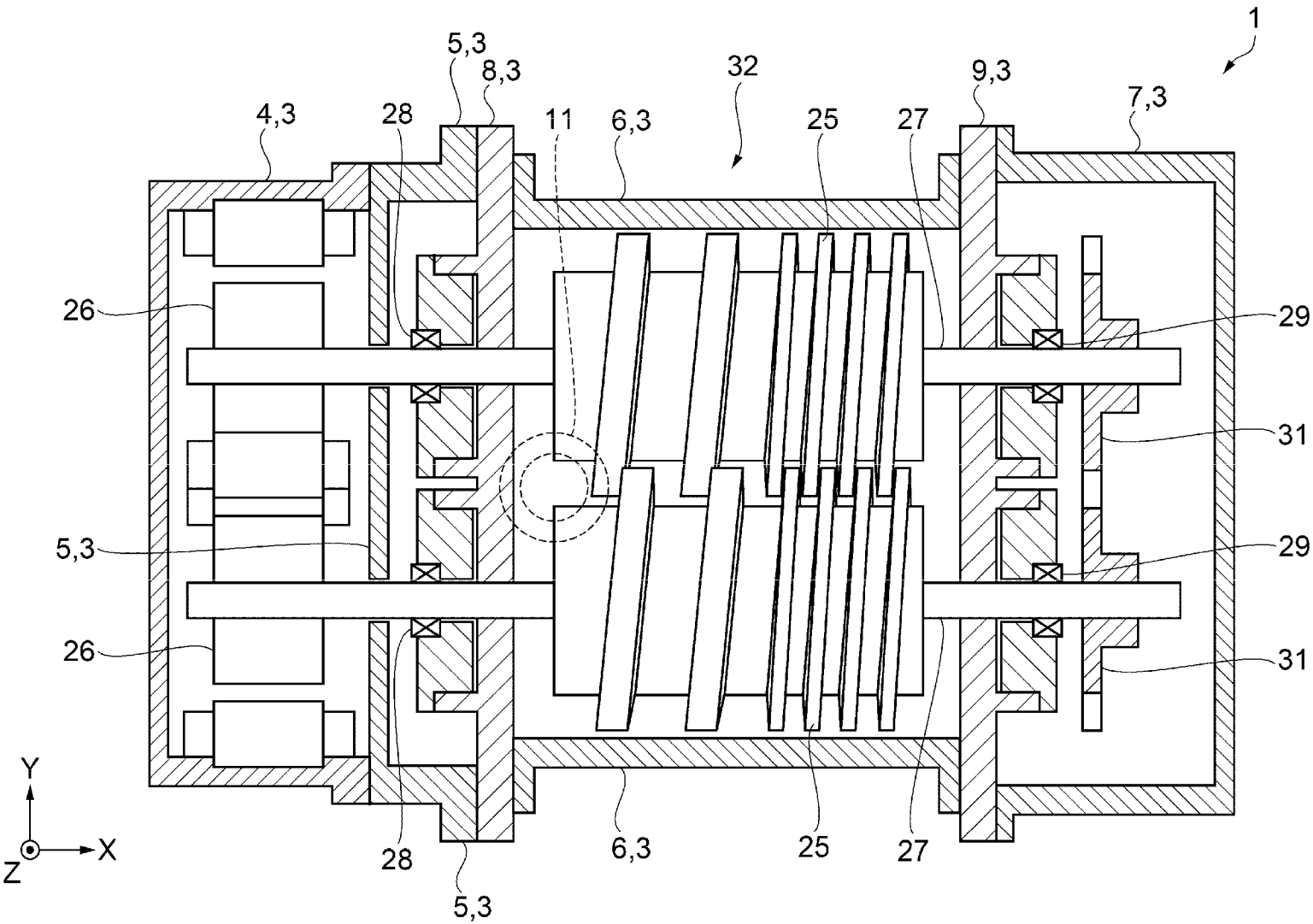
FIG. 3 is a schematic plan sectional view showing the internal structure of the vacuum pump.

The internal structure of the vacuum pump 1 is explained with reference to FIGS. 2 and 3. FIG. 2 is a view from the −Y direction. FIG. 3 is a view from the +Z direction. In FIGS. 2 and 3, the first leg section 13 to the fourth leg section are omitted. The vacuum pump 1 includes two pump rotors 25 functioning as movable bodies that transfer gas and two motors 26 that rotate the two pump rotors 25. The housing 3 houses the pump rotors 25.

The two pump rotors 25 include two rotating shafts 27. First bearings 28 and second bearings 29 respectively rotatably support the two rotating shafts 27. The two motors 26 are coupled to one ends of the respective rotating shafts 27. The motors 26 are configured to rotate the two pump rotors 25 in synchronization in opposite directions each other. Two timing gears 31 are fixed to the other ends of the rotating shafts 27. The timing gears 31 are provided to secure synchronized rotation of the two pump rotors 25 when the synchronized rotation of the two motors 26 is lost.

The pump case 6 is sandwiched by the first sidewall 8 and the second sidewall 9. The pump rotors 25 are disposed in a pump chamber 32 configured by the pump case 6, the first sidewall 8, and the second sidewall 9.

The first sidewall 8 supports the first bearings 28 on the intake pipe 11 side. The first bearings 28 are disposed in the connecting section 5. The motors 26 are disposed in the motor case 4 fixed to the connecting section 5. The second bearings 29 on the exhaust pipe 12 side are fixed to the second sidewall 9. The timing gears 31 and the second bearings 29 are disposed in the gear case 7. The first bearings 28 and the second bearings 29 vibrate according to rotation of the pump rotors 25. The vibration of the first bearings 28 and the second bearings 29 is transmitted to the housing 3 for the pump case 6 and the like via the first sidewall 8 and the second sidewall 9.

As shown in FIG. 2, the pump case 6, which is a part of the housing 3, includes the first channels 21 for causing water 33 functioning as a coolant to flow to overlap the monitoring device 16 in a plan view from a direction perpendicular to the attachment surface for the monitoring device 16. With this configuration, the first channels 21 are disposed to be opposed to the monitoring device 16. The water 33 flowing in the first channels 21 cools the monitoring device 16. Therefore, it is possible to prevent the temperature of the monitoring device 16 from rising even in places where the temperature of the housing 3 rises near the first bearings 28 and the second bearings 29, which are vibration sources. As a result, the monitoring device 16 can operate at temperature at which vibration can be accurately detected. Therefore, the monitoring device 16 can accurately detect vibration.

The pump case 6, which is a part of the housing 3, includes the second channels 23 for causing the water 33 to flow to portions opposed to the pump rotors 25. The water 33 in the second channels 23 prevents a temperature rise of the entire vacuum pump 1. Specifically, the first channels 21 is disposed in the pump case 6 in a portion opposed to the monitoring device 16. The second channels 23 are disposed in the pump case 6 in a portion not opposed to the monitoring device 16.

The first channels 21 have higher density than the second channels 23. The density indicates a total of sectional areas of a channel per unit area of a cross section orthogonal to the channel. With this configuration, since the first channels 21 have the higher density than the second channels 23, the monitoring device 16 can be efficiently cooled.

Specifically, a channel sectional area of the first channels 21 and a channel sectional area of the second channels 23 are the same. The number of the first channels 21 included in a predetermined area when viewed from the Y direction in which the water 33 flows in the pump case 6 is larger than the number of the second channels 23. With this configuration, the channel sectional area of the first channels 21 and the channel sectional area of the second channels 23 are the same. The first channels 21 and the second channels 23 can be formed by the same cutting tool. The first channels 21 and the second channels 23 can be formed with high productivity. The number of the first channels 21 included in the predetermined area when viewed from the Y direction in which the water 33 flows is larger than the number of the second channels 23. Therefore, the density of the first channels 21 can be set higher than the density of the second channels 23.

The first channels 21 and the second channels 23 having a linear shape are set in the housing 3. The first pipes 22 are disposed in portions where the first channels 21 exit the housing 3. The first channels 21 adjacent to one another in the housing 3 are coupled by the first channels 21 in the first pipes 22. Similarly, the second pipes 24 are disposed in portions where the second channels 23 exit the housing 3. The second channels 23 adjacent to one another in the housing 3 are coupled by the second channels 23 in the second pipes 24.

The housing 3 is a casting. The housing 3 is formed by pouring a material into a mold. The first channels 21 and the second channels 23 are formed by forming linear through-holes in the housing 3 with a drill. The through-holes are coupled by inserting the first pipes 22 and the second pipes 24 into the through-holes.

Figure 4:
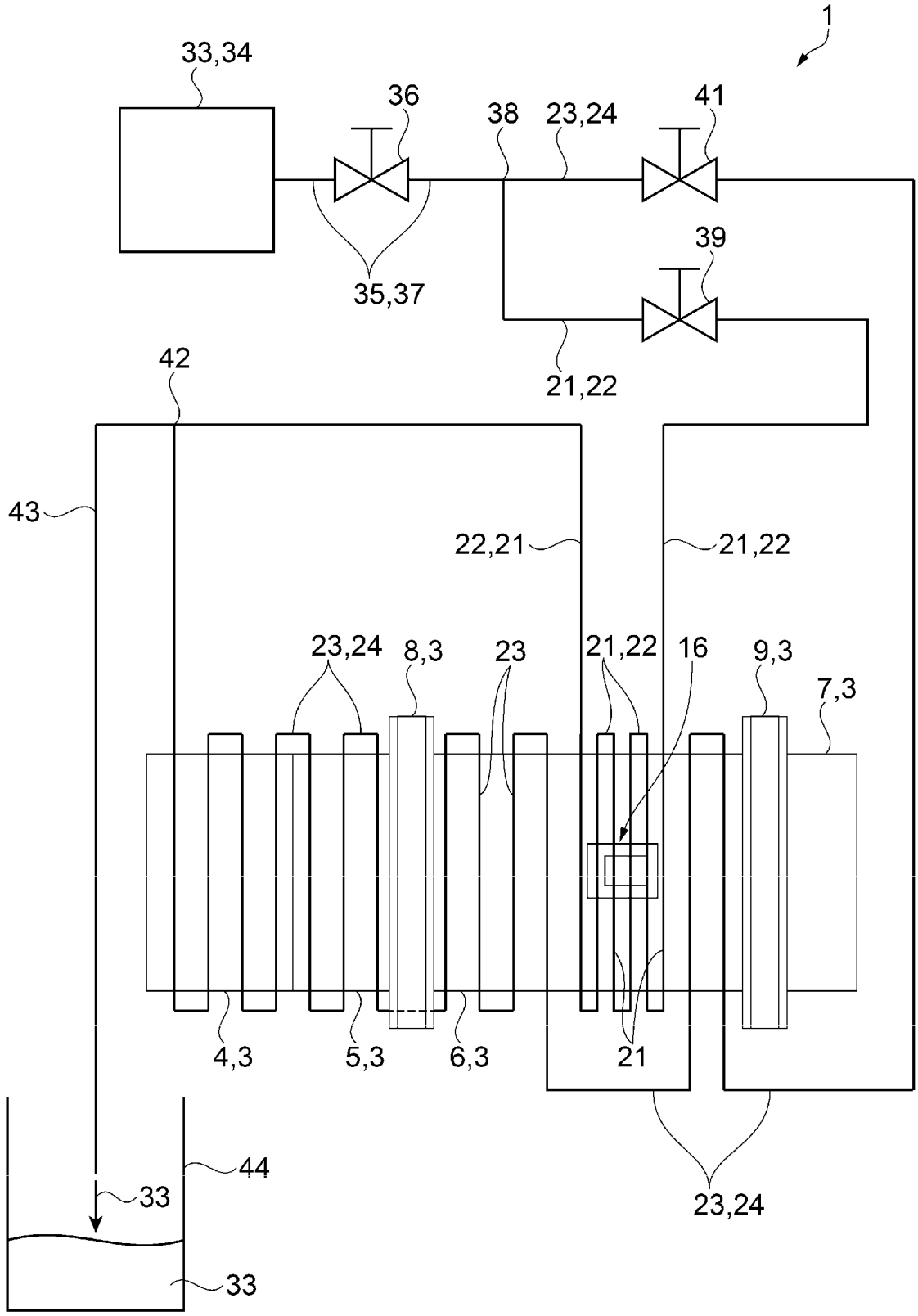
FIG. 4 is a block diagram showing the configuration of a channel.

As shown in FIG. 4, the water 33 flows in a supply pipe 35 from a water source 34 to be supplied. The water 33 is industrial water. A first valve 36 is set in the supply pipe 35. An operator operates the first valve 36 to adjust a flow rate of the water 33 flowing in the supply pipe 35. The inside of the supply pipe 35 is a supply channel 37. Similarly, the inside of the first pipe 22 is the first channel 21. The inside of the second pipe 24 is the second channel 23.

The vacuum pump 1 includes a dividing section 38 that divides the supply channel 37 for supplying the water 33 into the first channel 21 and the second channel 23. With this configuration, the water 33 flowing in the supply channel 37 is supplied to the first channel 21 and the second channel 23. The temperature of the water 33 flowing in the first channel 21 is not affected by the temperature of the water 33 flowing in the second channel 23. Therefore, the first channel 21 can stably cool the monitoring device 16.

In an example in this embodiment, the temperature of the pump rotors 25 are approximately 70 degrees to 90 degrees. The temperature of the portions of the first bearings 28 and the second bearings 29 are approximately 100 degrees. A temperature compensation range of the monitoring device 16 is −40 degrees to 80 degrees. However, for the monitoring device 16 to accurately detect vibration of the housing 3, it is preferable to set the temperature of the housing 3 in a place where the monitoring device 16 is set to 15 degrees or higher and 45 degrees or lower. The temperature of the water 33 supplied from the supply channel 37 is approximately 20 degrees. The water 33 flowing in the second channel 23 removes heat of the entire vacuum pump 1. The water 33 flowing in the first channel 21 removes heat of the housing 3 in a place opposed to the monitoring device 16.

A second valve 39 is set in the first channel 21. The operator operates the second valve 39 to adjust a flow rate of the water 33 flowing in the first channel 21. A third valve 41 is set in the second channel 23. The operator operates the third valve 41 to adjust a flow rate of the water 33 flowing in the second channel 23. The operator adjusts the first valve 36, the second valve 39, and the third valve 41 to maintain the temperature of the housing 3 in the place where the monitoring device 16 is set at 15 degrees or higher and 45 degrees or lower.

The second channel 23 passes the pump case 6, the connecting section 5, and the motor case 4 in this order. The water 33 flowing in the second channel 23 is the lowest when flowing in the pump case 6 and is the highest when flowing in the motor case 4. The first channel 21 and the second channel 23 in which the water 33 having passed through the housing 3 flows merge in a merging section 42 and are coupled to a discharge channel 43. The water 33 having passed through the discharge channel 43 is discharged to a drainage channel 44. Order of the second channel 23 passing the sections in the housing 3 is not particularly limited.

A coolant flowing in the first channel 21 and the second channel 23 to cool the housing 3 is the water 33. With this configuration, since the coolant is the water 33, the industrial water can be used. Therefore, a device that circulates the coolant is unnecessary. The vacuum pump 1 can be constructed with high productivity.

Second Embodiment

Figure 5:
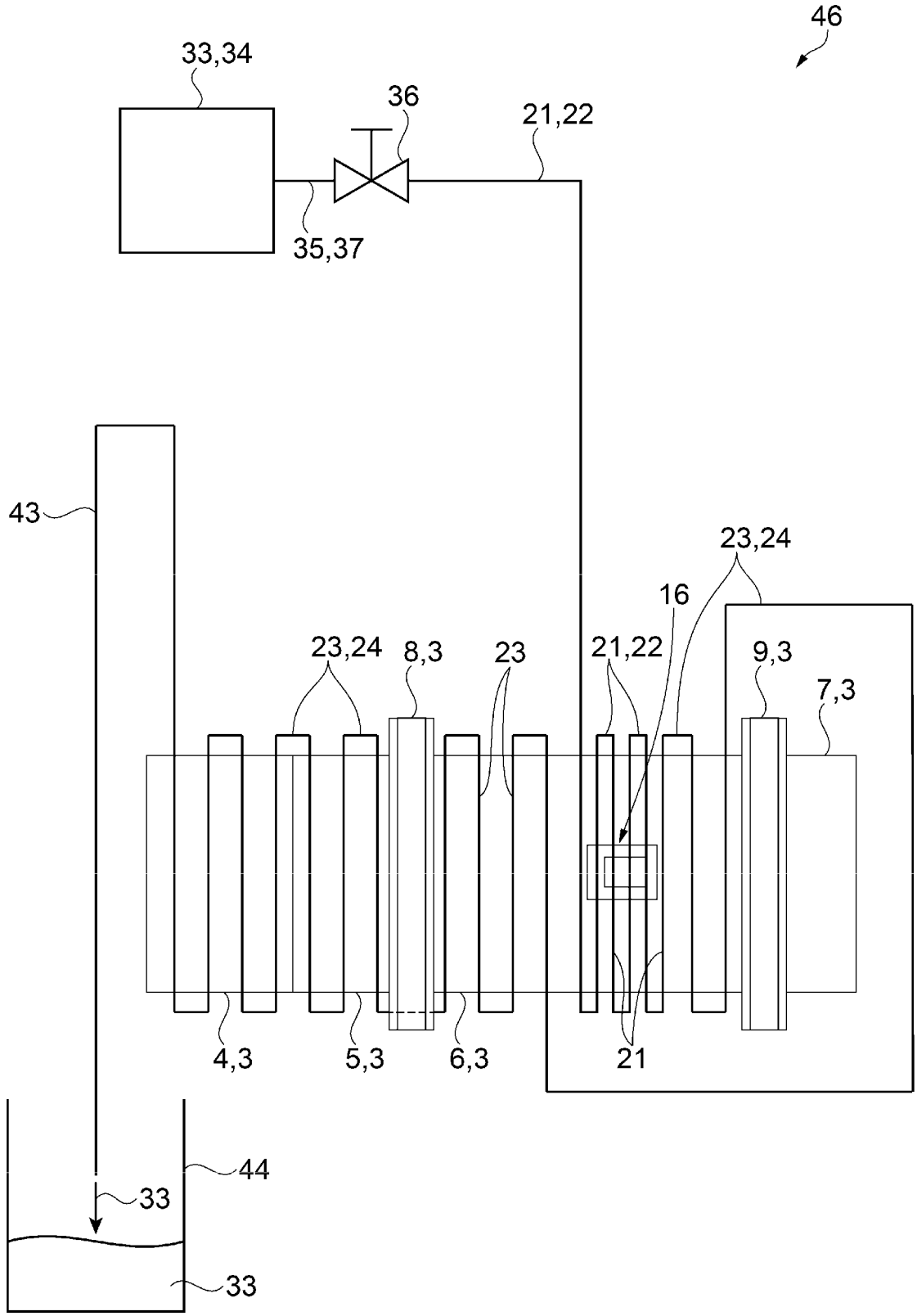
FIG. 5 is a block diagram showing the configuration of a channel according to a second embodiment.

A second embodiment is different from the first embodiment in that the first channel 21 and the second channel 23 are coupled in series. As shown in FIG. 5, in a vacuum pump 46 functioning as a device, the supply channel 37 is coupled to the first channel 21 via the first valve 36. As in the first embodiment, the housing 3 includes the first channel 21 for causing the water 33 to flow to the portion opposed to the monitoring device 16. The housing 3 includes the second channel 23 for causing the water 33 to flow to the portions opposed to the pump rotors 25. The channel 21 having passed through the housing 3 is coupled to the second channel 23. The second channel 23 having passed through the housing 3 is coupled to the discharge channel 43.

Therefore, the supply channel 37 for supplying the water 33, the first channel 21, and the second channel 23 are coupled in series in this order. With this configuration, for example, when the water 33 having passed through the first channel 21 is supplied to the second channel 23, the temperature of the water 33 flowing in the first channel 21 is less easily affected by the temperature of the water 33 flowing in the second channel 23. Therefore, the first channel 21 can stably cool the monitoring device 16.

In the vacuum pump 46, the lengths of the first pipe 22 and the second pipe 24 can be set shorter compared with the first embodiment. Therefore, the vacuum pump 46 can be a device manufacturable with high productivity.

Third Embodiment

Figure 6:
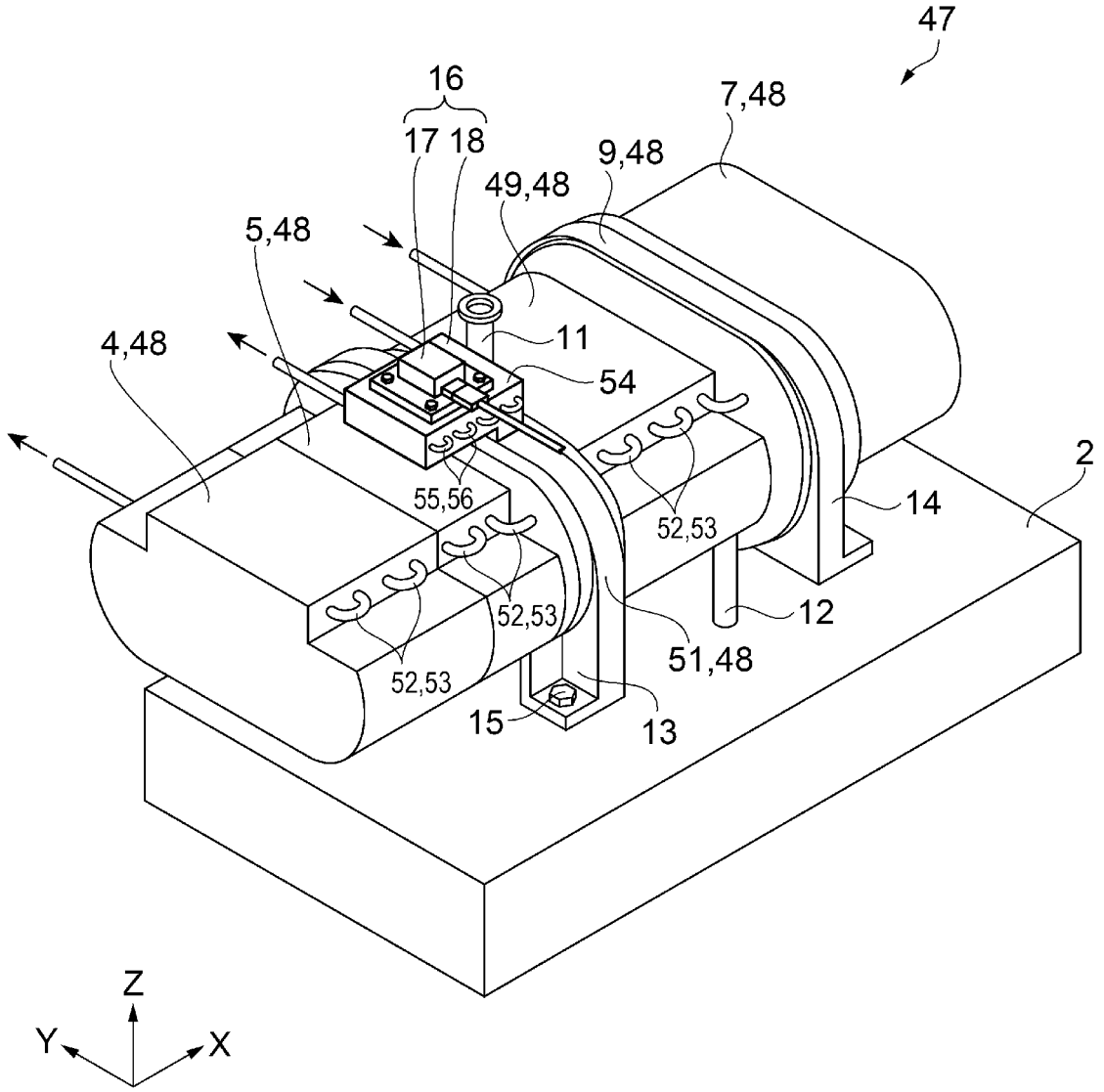
FIG. 6 is a schematic perspective view showing the configuration of a vacuum pump according to a third embodiment.
Figure 7:
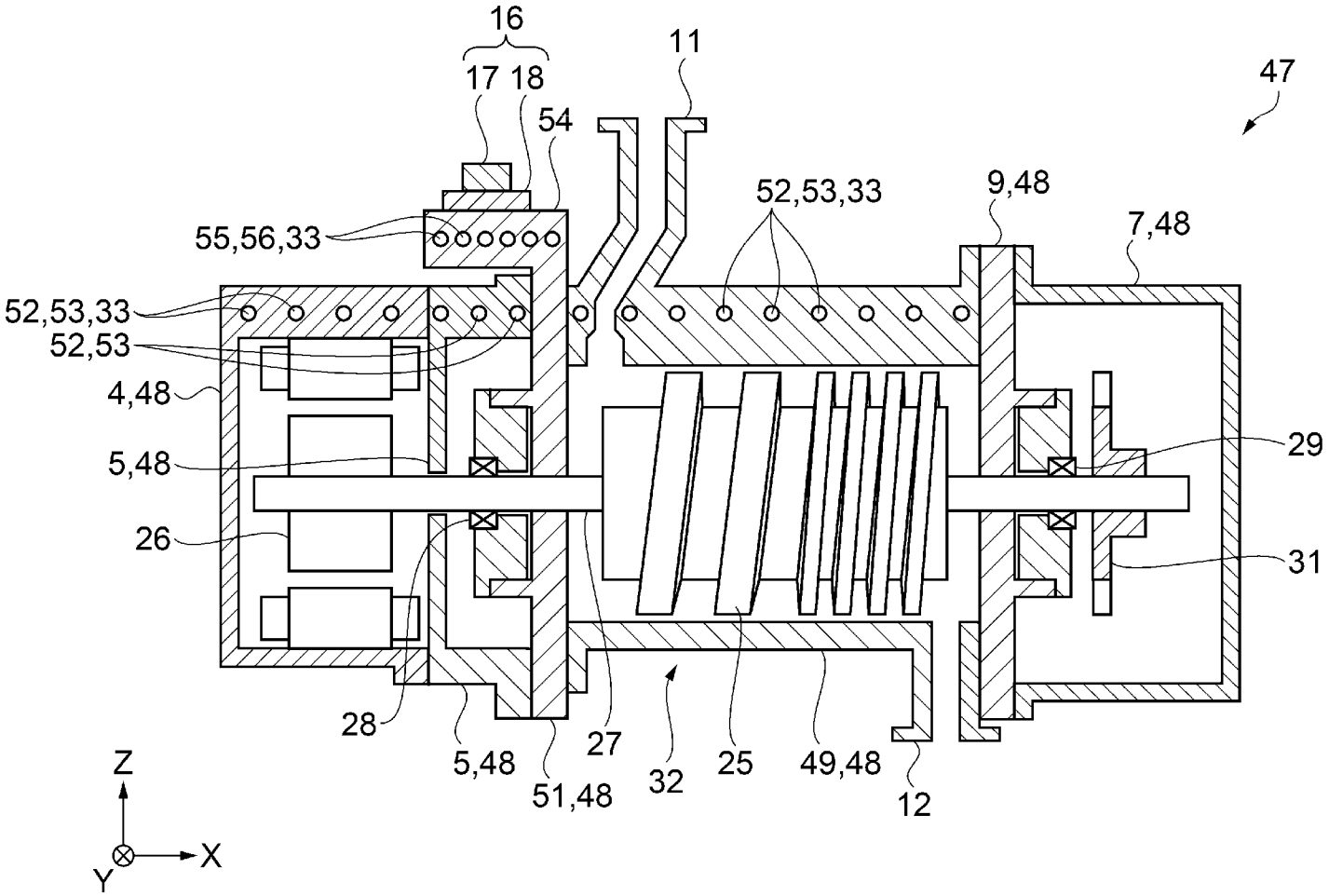
FIG. 7 is a schematic side sectional view showing the internal structure of the vacuum pump.

A third embodiment is different from the first embodiment in that the monitoring device 16 is set on the first sidewall 8. As shown in FIGS. 6 and 7, a vacuum pump functioning as a device includes a housing 48. The housing 48 includes the motor case 4, the connecting section 5, a pump case 49, and the gear case 7 disposed from the −X-direction side toward the +X-direction side. The housing includes a first sidewall 51 between the connecting section 5 and the pump case 49. The housing 48 includes the second sidewall 9 between the pump case 49 and the gear case 7.

The motor case 4, the connecting section 5, and the pump case 49 include second channels 52 and second pipes 53 for causing the water 33 to flow. The housing 48 includes the second channels 52 for causing the water 33 to flow to the portions opposed to the pump rotors 25. The second pipes 53 are disposed in portions where the second channels 52 exit the housing 48. The second channels 52 adjacent to one another in the housing 48 are coupled by the second channels 52 in the second pipes 53.

The first sidewall 51 includes an attachment stand 54. The monitoring device 16 is attached to the attachment stand 54. The attachment stand 54 is a part of the housing 48. The attachment stand 54 includes first channels 55 and first pipes 56 for causing the water 33 to flow. The housing 48 includes the first channels 55 for causing the water 33 to flow to a portion opposed to the monitoring device 16. The first channels 55 having a linear shape are set in the housing 48. The first pipes 56 are disposed in portions where the first channels 55 exit the housing 48. The first channels 55 adjacent to one another in the housing 48 are coupled by the first channels 55 in the first pipes 56.

Figure 8:
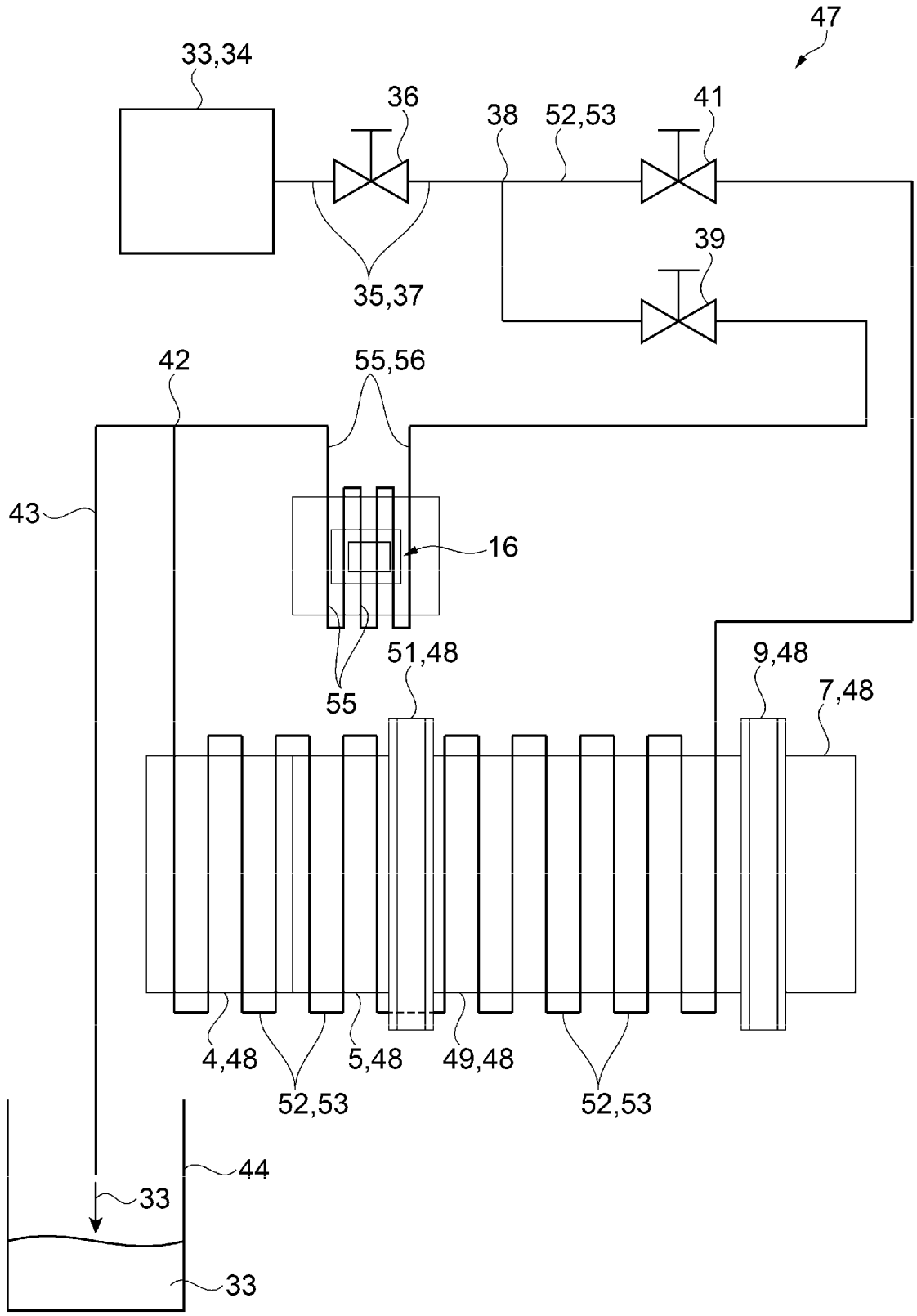
FIG. 8 is a block diagram showing the configuration of a channel.

As shown in FIG. 8, the inside of the first pipe 56 is the first channel 55 and the inside of the second pipe 53 is the second channel 52. The vacuum pump 47 includes the dividing section 38 that divides the supply channel 37 for supplying the water 33 into the first channel 55 and the second channel 52. With this configuration, the water 33 flowing in the supply channel 37 is supplied to the first channel 55 and the second channel 52. The temperature of the water 33 flowing in the first channel 55 is not affected by the temperature of the water 33 flowing in the second channel 52. Therefore, the first channel 55 can stably cool the monitoring device 16.

Fourth Embodiment

Figure 9:
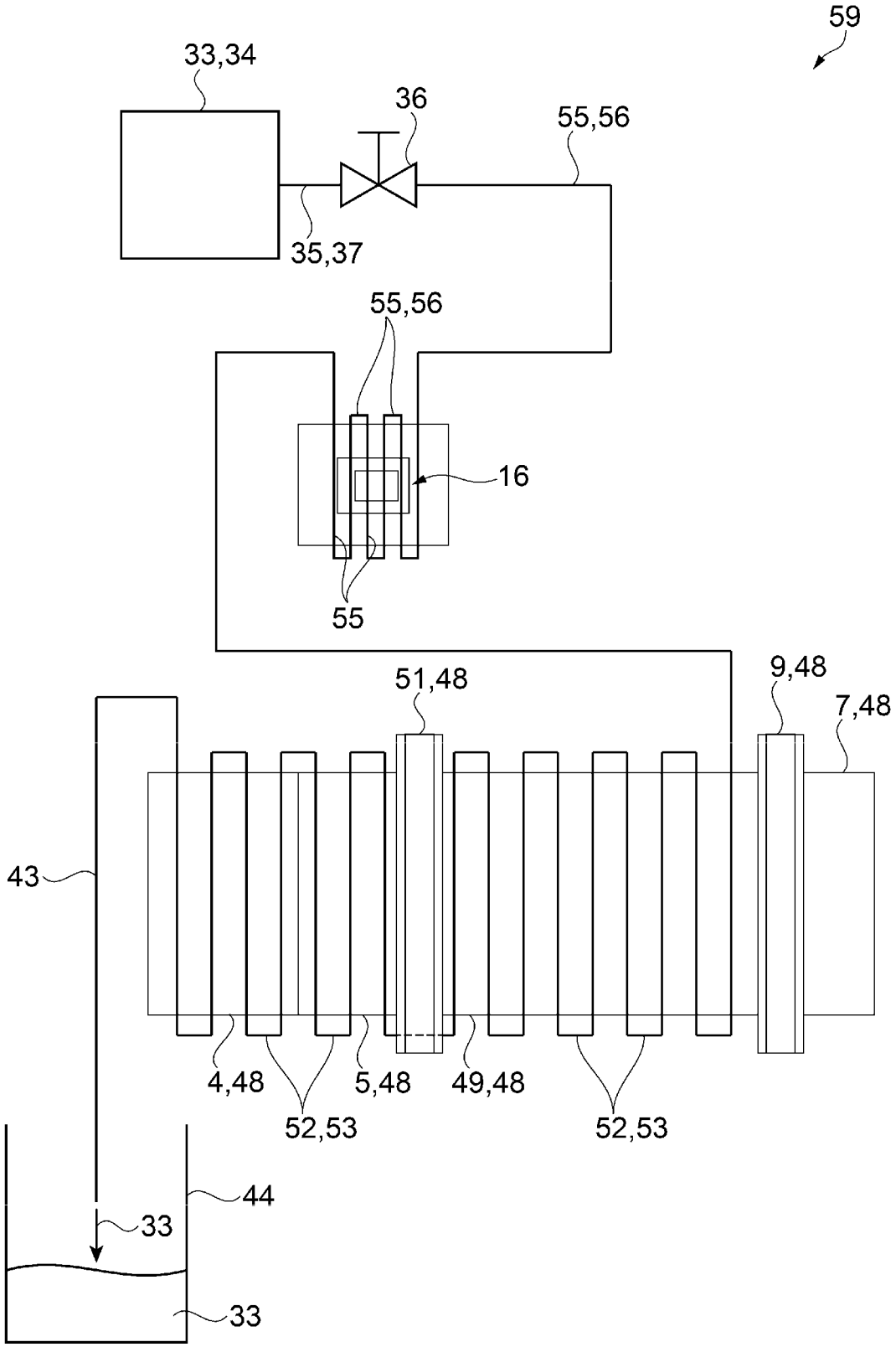
FIG. 9 is a block diagram showing the configuration of a channel according to a fourth embodiment.

A fourth embodiment is different from the third embodiment in that the first channel 55 and the second channel 52 are coupled in series. As shown in FIG. 9, in a vacuum pump 59 functioning as a device, the supply channel 37 is coupled to the first channel 55 via the first valve 36. As in the third embodiment, the housing 48 includes the first channel 55 for causing the water 33 to flow to the portion opposed to the monitoring device 16. The housing 48 includes the second channel 52 for causing the water 33 to flow to the portion opposed to the pump rotors 25. The first channel 55 having passed through the housing 48 is coupled to the second channel 52. The second channel 52 having passed through the housing 48 is coupled to the discharge channel 43.

Therefore, the supply channel 37 for supplying the water 33, the first channel 55, and the second channel 52 are coupled in series in this order. With this configuration, for example, when the water 33 having passed through the first channel 55 is supplied to the second channel 52, the temperature of the water 33 flowing in the first channel 55 is less easily affected by the temperature of the water 33 flowing in the second channel 52. Therefore, the first channel 55 can stably cool the monitoring device 16.

In the vacuum pump 59, the lengths of the first pipe 56 and the second pipe 53 can be set shorter compared with the third embodiment. Therefore, the vacuum pump 59 can be a device manufacturable with high productivity.

Fifth Embodiment

In the first embodiment, the monitoring device 16 is set in the vacuum pump 1. The vacuum pump 1 is illustrated as the device. However, a type of the vacuum pump 1 is not particularly limited. The vacuum pump 1 may be various devices including rotating mechanisms such as a hydraulic pump and a water pump.

Sixth Embodiment

Figure 10:
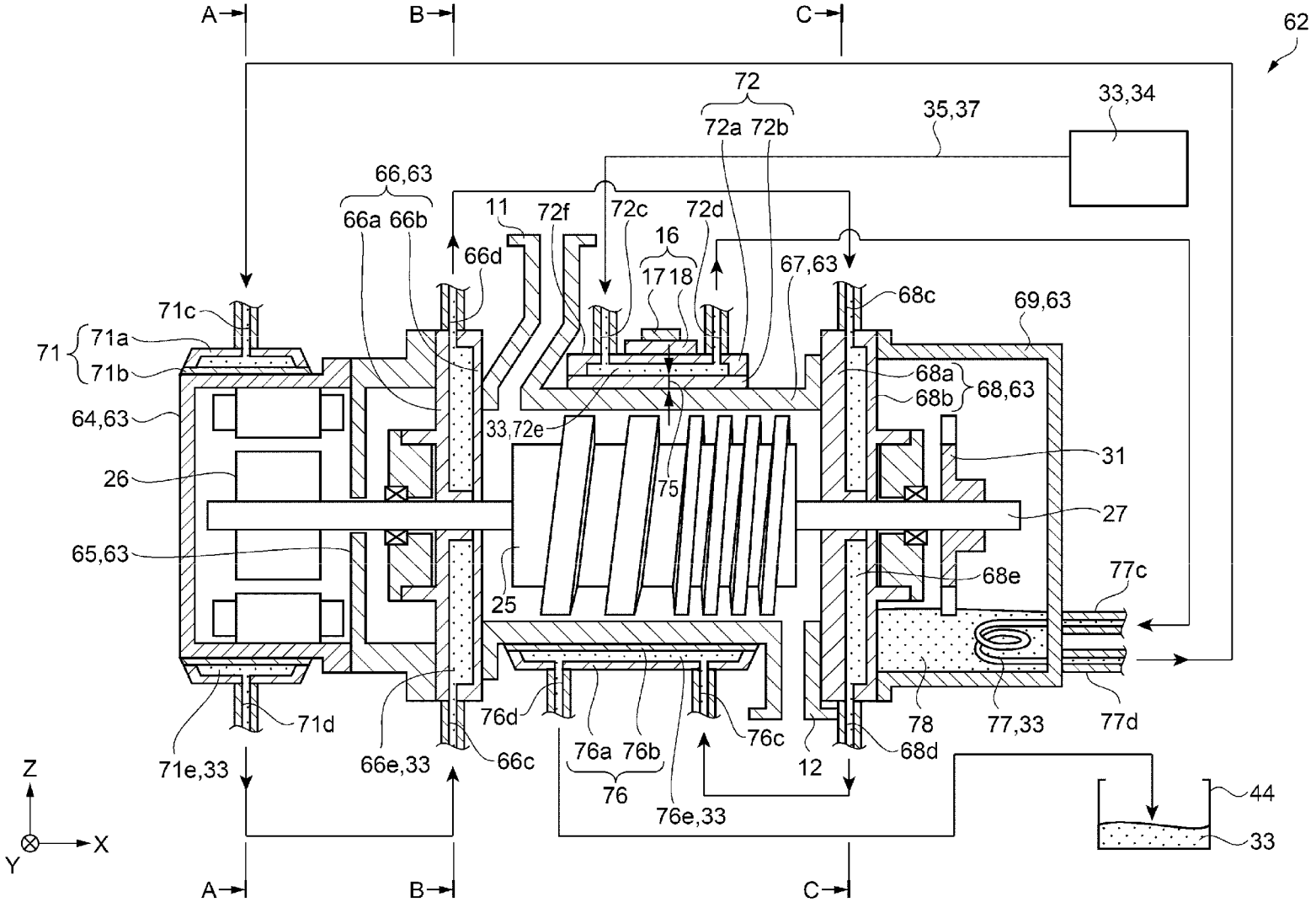
FIG. 10 is a schematic side sectional view showing the configuration of a vacuum pump according to a sixth embodiment.

A sixth embodiment is different from the first embodiment in that a form of a channel for cooling the vacuum pump 1 is different. As shown in FIG. 10, a vacuum pump 62 functioning as a device includes a housing 63. The housing 63 includes a motor case 64, a connecting section 65, a first sidewall 66, a pump case 67, a second sidewall 68, and a gear case 69. The motor case 64, the connecting section 65, the first sidewall 66, the pump case 67, the second sidewall 68, and the gear case 69 are respectively equivalent to the motor case 4, the connecting section 5, the first sidewall 8, the pump case 6, the second sidewall 9, and the gear case 7 in the first embodiment.

Figure 11:
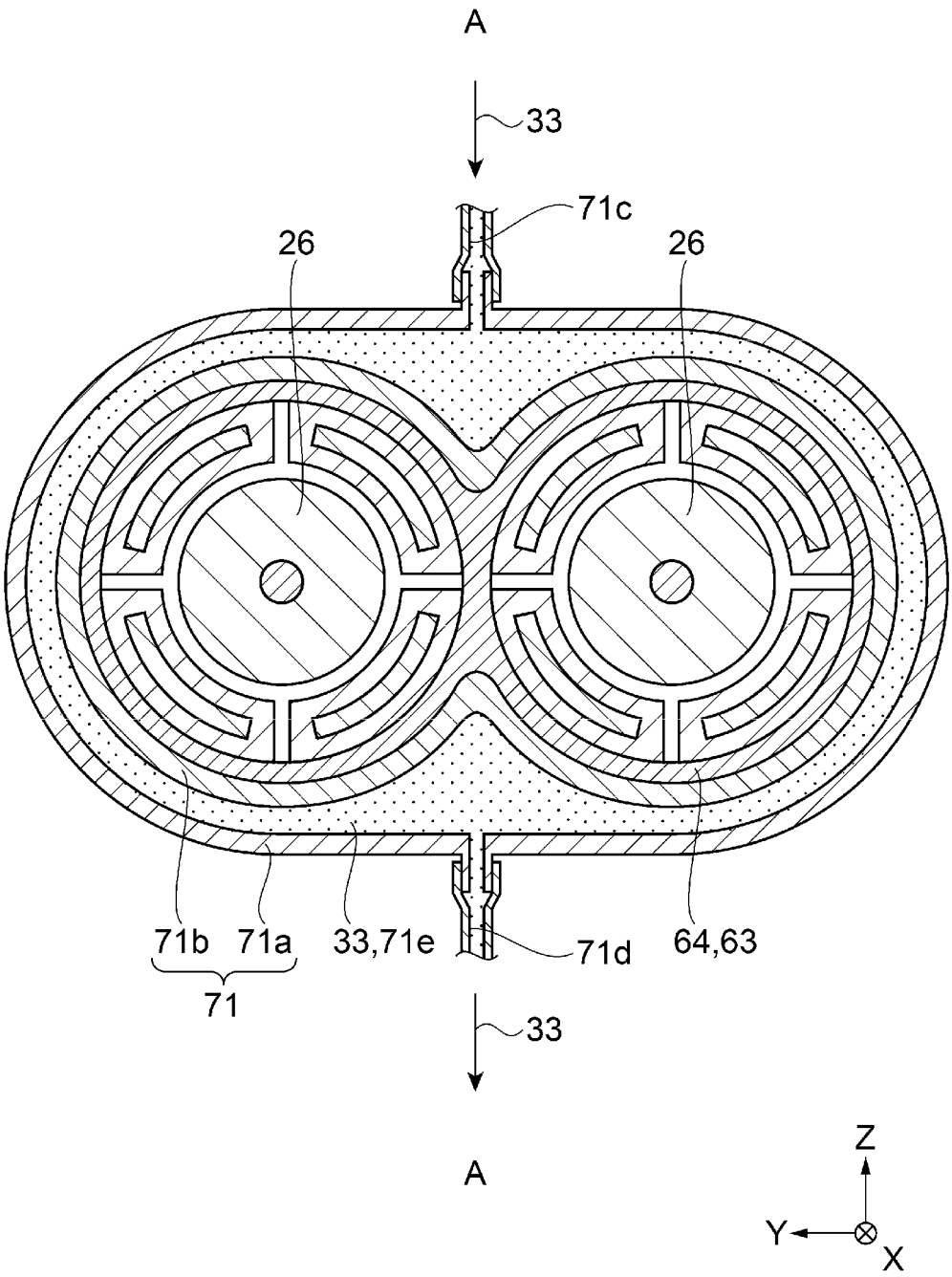
FIG. 11 is a schematic side sectional view showing the configuration of a motor cooling section.

FIG. 11 is a sectional view of a cross section taken along an AA line in FIG. 10. As shown in FIGS. 10 and 11, a motor cooling section 71 is disposed to surround the motor case 64 on the +Y-direction side, the −Y-direction side, the +Z-direction side, and the −Z-direction side of the motor case 64. The motor cooling section 71 includes a first top plate 71*a* and a first bottom plate 71*b*. The first top plate 71*a* includes a recess on the first bottom plate 71*b* side. The first top plate 71*a* and the first bottom plate 71*b* are joined. The recess is formed as a first hollow 71*e*. The first bottom plate 71*b* is fixed in contact with the motor case 64.

The first top plate 71*a* includes a first water inlet port 71*c* and a first water outlet port 71*d*. The first water inlet port 71*c* and the first water outlet port 71*d* communicate with the first hollow 71*e*. The water 33 is filled in the first hollow 71*e*. Heat of the motors 26 is absorbed by the water 33 in the first hollow 71*e*. The water 33 supplied from the first water inlet port 71*c* absorbs the heat and is discharged from the first water outlet port 71*d*. As a result, the motors 26 are cooled. The first hollow 71*e* is formed as a channel wide in the X direction.

Figure 12:
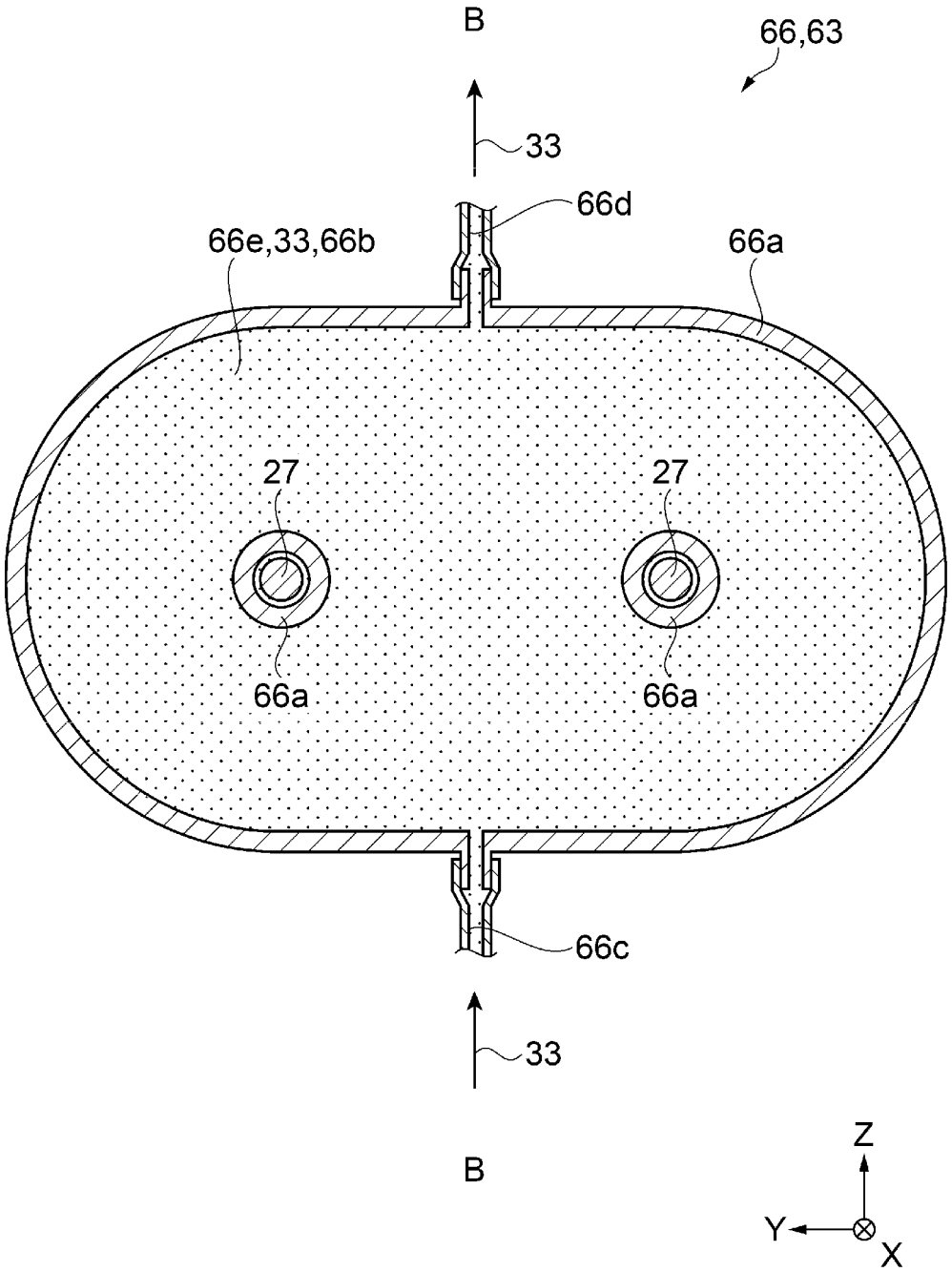
FIG. 12 is a schematic side sectional view showing the structure of a first sidewall.

FIG. 12 is a sectional view of a cross section taken along a BB line in FIG. 10. As shown in FIGS. 10 and 12, the first sidewall 66 includes a first side plate 66*a* and a second side plate 66*b*. The first side plate 66*a* includes a recess on the second side plate 66*b* side. The first side plate 66*a* and the second side plate 66*b* are joined. The recess is formed as a second hollow 66*e*.

The first side plate 66*a* includes a second water inlet port 66*c* and a second water outlet port 66*d*. The second water inlet port 66*c* and the second water outlet port 66*d* communicate with the second hollow 66*e*. The water 33 is filled in the second hollow 66*e*. Heat of the motors 26 and the pump rotors 25 is absorbed by the water 33 in the second hollow 66*e*. The water 33 supplied from the second water inlet port 66*c* absorbs the heat and is discharged from the second water outlet port 66*d*. As a result, the motors 26 and the pump rotors 25 are cooled.

Figure 13:
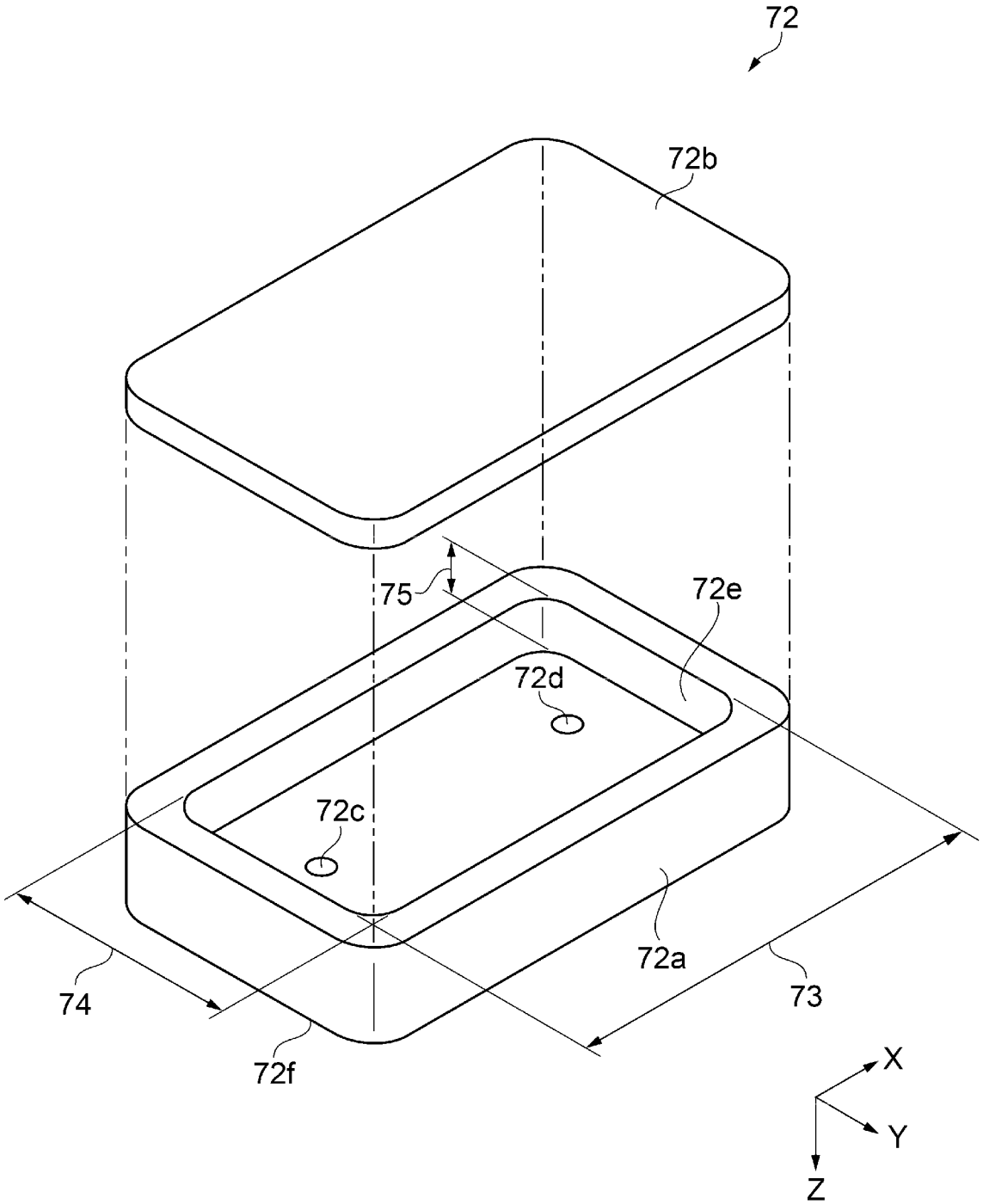
FIG. 13 is a schematic perspective view showing the configuration of a sensor cooling section.

As shown in FIGS. 10 and 13, a sensor cooling section 72 is set on the +Z-direction side of the pump case 67. The sensor cooling section 72 includes a third top plate 72*a* and a third bottom plate 72*b*. The third top plate 72*a* includes a recess on the third bottom plate 72*b* side. The third top plate 72*a* and the third bottom plate 72*b* are joined. The recess is formed as a third hollow 72*e* functioning as a first channel. The third bottom plate 72*b* is fixed in contact with the pump case 67.

The third top plate 72*a* includes a third water inlet port 72*c* and a third water outlet port 72*d*. The third water inlet port 72*c* and the third water outlet port 72*d* communicate with the third hollow 72*e*. The water 33 is filled in the third hollow 72*e*. Heat of the pump rotors 25 is absorbed by the water 33 in the third hollow 72*e*. The water 33 supplied from the third water inlet port 72*c* absorbs the heat and is discharged from the third water outlet port 72*d*. As a result, the temperature of the monitoring device 16 is maintained. The third hollow 72*e* is formed as a channel wide in the Y direction, the water 33 flowing in the channel in a positive direction.

A surface on the +Z-direction side of the sensor cooling section 72 is an attachment surface 72*f* for the monitoring device 16. The monitoring device 16 is attached to the attachment surface 72*f*. The length in the X direction of the third hollow 72*e* is a first length 73. The length in the Y direction of the third hollow 72*e* is a second length 74. The first length 73 and the second length 74 are the lengths in a direction parallel to the attachment surface 72*f*. A third length 75 is the length in the Z direction of the third hollow 72*e*. The third length 75 is the length of the third hollow 72*e* in a direction perpendicular to the attachment surface 72*f*. The first length 73 and the second length 74 are larger than the third length 75. Therefore, the length of a sectional shape of the third hollow 72*e* in a direction parallel to the attachment surface 72*f* for the monitoring device 16 is larger than the length in a direction perpendicular to the attachment surface 72*f* for the monitoring device 16.

With this configuration, a channel by the third hollow 72*e* can be more easily manufactured compared with the first channel 21 in the first embodiment. Since the channel is wider and shorter, fluid resistance can be set smaller compared with the first channel 21 in the first embodiment.

The housing 63 includes the third hollow 72*e* for causing the water 33 to flow to overlap the monitoring device 16 in a plan view from the direction perpendicular to the attachment surface 72*f* for the monitoring device 16.

Figure 14:
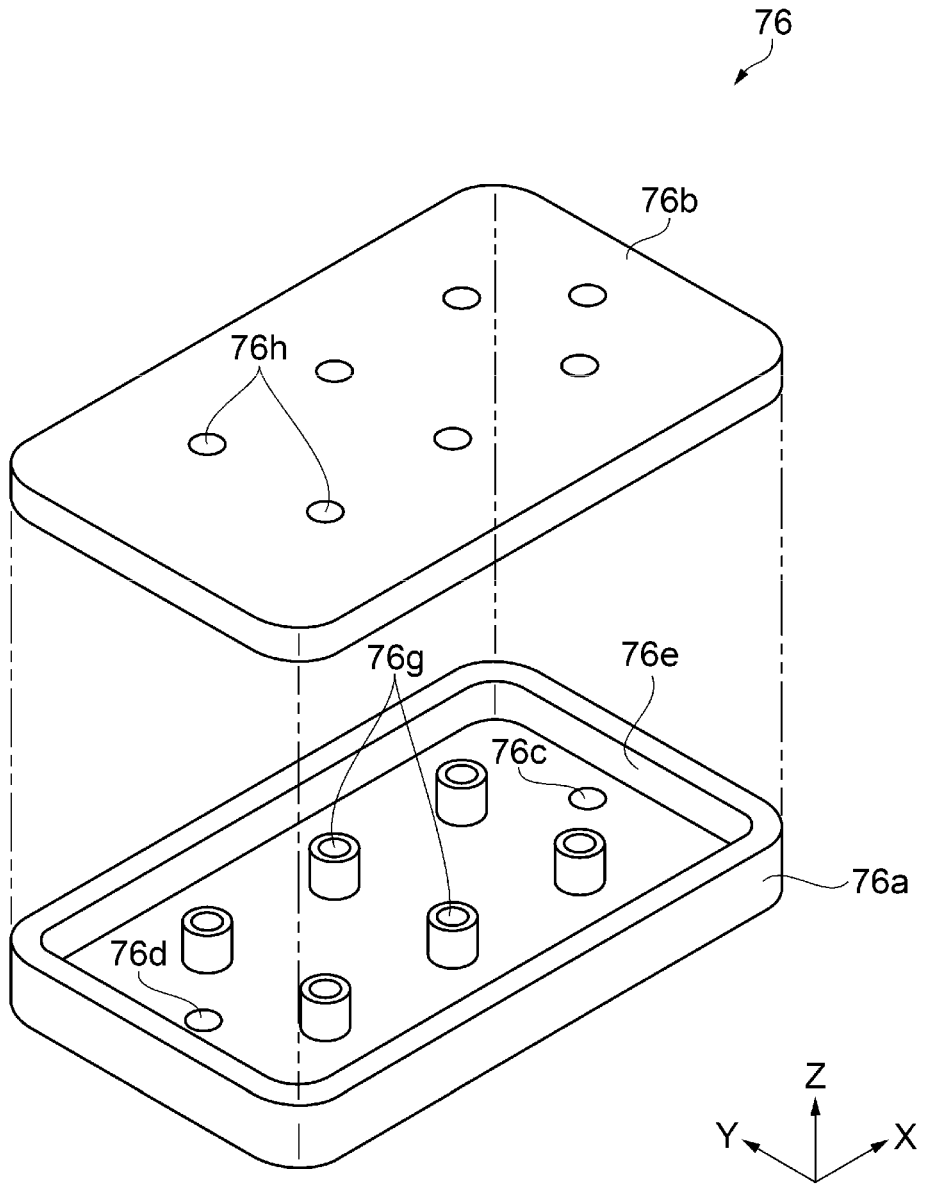
FIG. 14 is a schematic perspective view showing the configuration of a pump cooling section.

As shown in FIGS. 10 and 14, a pump cooling section 76 is set on the −Z-direction side of the pump case 67. The pump cooling section 76 includes a fourth top plate 76*a* and a fourth bottom plate 76*b*. The fourth top plate 76*a* includes a recess on the fourth bottom plate 76*b* side. The fourth top plate 76*a* and the fourth bottom plate 76*b* are joined. The recess is formed as a fourth hollow 76*e* functioning as a second channel. The fourth bottom plate 76*b* is fixed in contact with the pump case 67.

When a gap is present between the fourth bottom plate 76*b* and the pump case 67, the sensor unit 17 is affected by noise. Therefore, it is preferable to increase flatness of the components and join the components.

The housing 63 includes the fourth hollow 76*e* for causing the water 33 to flow to the portions opposed to the pump rotors 25. The supply channel 37 for supplying the water 33, the third hollow 72*e*, and the fourth hollow 76*e* are coupled in series in this order.

First through-holes 76*g* are formed in the fourth top plate 76*a*. Second through-holes 76*h* are formed in the fourth bottom plate 76*b*. Female screws are formed on the surface on the −Z-direction side of the pump case 67. Bolts pass through the first through-holes 76*g* and the second through-holes 76*h* and screw in the female screws of the pump case 67. The pump cooling section 76 is fixed to the pump case 67 by the bolts.

The fourth top plate 76*a* includes a fourth water inlet port 76*c* and a fourth water outlet port 76*d*. The fourth water inlet port 76*c* and the fourth water outlet port 76*d* communicate with the fourth hollow 76*e*. The water 33 is filled in the fourth hollow 76*e*. Heat of the pump rotors 25 is absorbed by the water 33 in the fourth hollow 76*e*. The water 33 supplied from the fourth water inlet port 76*c* absorbs heat and is discharged from the fourth water outlet port 76*d*. As a result, the pump rotors 25 are cooled.

Figure 15:
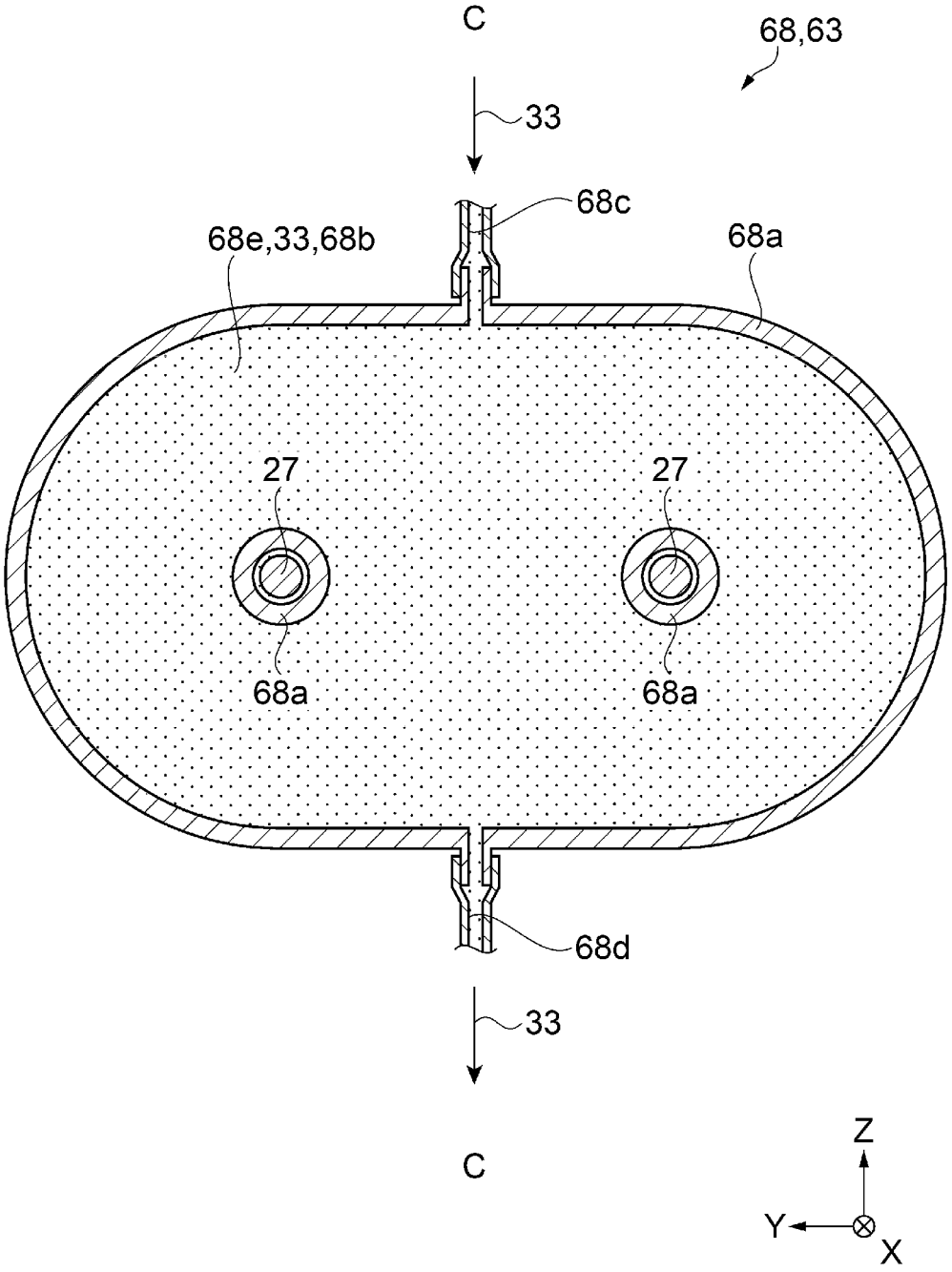
FIG. 15 is a schematic side sectional view showing the structure of a second sidewall.

FIG. 15 is a sectional view of a cross section taken along a CC line in FIG. 10. As shown in FIGS. 10 and 15, the second sidewall 68 includes a third side plate 68*a* and a fourth side plate 68*b*. The third side plate 68*a* includes a recess on the fourth side plate 68*b* side. The third side plate 68*a* and the fourth side plate 68*b* are joined. The recess is formed as a fifth hollow 68*e*.

The third side plate 68*a* includes a fifth water inlet port 68*c* and a fifth water outlet port 68*d*. The fifth water inlet port 68*c* and the fifth water outlet port 68*d* communicate with the fifth hollow 68*e*. The water 33 is filled in the fifth hollow 68*e*. Heat of the pump rotors 25 and the timing gears 31 is absorbed by the water 33 in the fifth hollow 68*e*. The water 33 supplied from the fifth water inlet port 68*c* absorbs the heat and is discharged from the fifth water outlet port 68*d*. As a result, the pump rotors 25 and the timing gears 31 are cooled.

As shown in FIG. 10, a cooling pipe 77 is set on the −Z-direction side on the inside of the gear case 69. Lubricating oil 78 for lubricating the timing gears 31 is poured into the inside of the gear case 69. The cooling pipe 77 is immersed in the lubricating oil 78.

The cooling pipe 77 includes a sixth water inlet port 77*c* and a sixth water outlet port 77*d*. The sixth water inlet port 77*c* and the sixth water outlet port 77*d* are coupled to the cooling pipe 77. Heat of the timing gears 31 is transferred to the lubricating oil 78. Heat of the lubricating oil 78 is absorbed by the water 33 flowing in the cooling pipe 77. The water 33 supplied from the sixth water inlet port 77*c* absorbs the heat and is discharged from the sixth water outlet port 77*d*. As a result, the lubricating oil 78 and the timing gears 31 are cooled.

The water source 34 and the third water inlet port 72*c* are coupled by the supply pipe 35. The water 33 supplied from the water source 34 passes through the supply channel 37, the sensor cooling section 72, the cooling pipe 77, the motor cooling section 71, the first sidewall 66, the second sidewall 68, and the pump cooling section 76 in this order and is discharged to the drainage channel 44. Since the water 33 in the water source 34 is cooled, the sensor cooling section 72 on upstream has the highest cooling ability.

It is preferable to use Ni-resist as the material of the sensor cooling section 72, the motor cooling section 71, the first sidewall 66, the second sidewall 68, and the pump cooling section 76. The Ni-resist is an alloy containing chrome, nickel, and copper other than iron. Characteristics of the Ni-resist include heat resistance, corrosion resistance, and a low coefficient of thermal expansion. Therefore, the life of the vacuum pump 62 can be extended.

The sensor cooling section 72, the motor cooling section 71, the first sidewall 66, the second sidewall 68, and the pump cooling section 76 may be casted. A shape having a recess can be easily manufactured.

As a method of fixing the sensor cooling section 72 to the pump case 67, screwing and welding can be used. Besides, the sensor cooling section 72 and the pump case 67 may be integrally formed.

Seventh Embodiment

Figure 16:
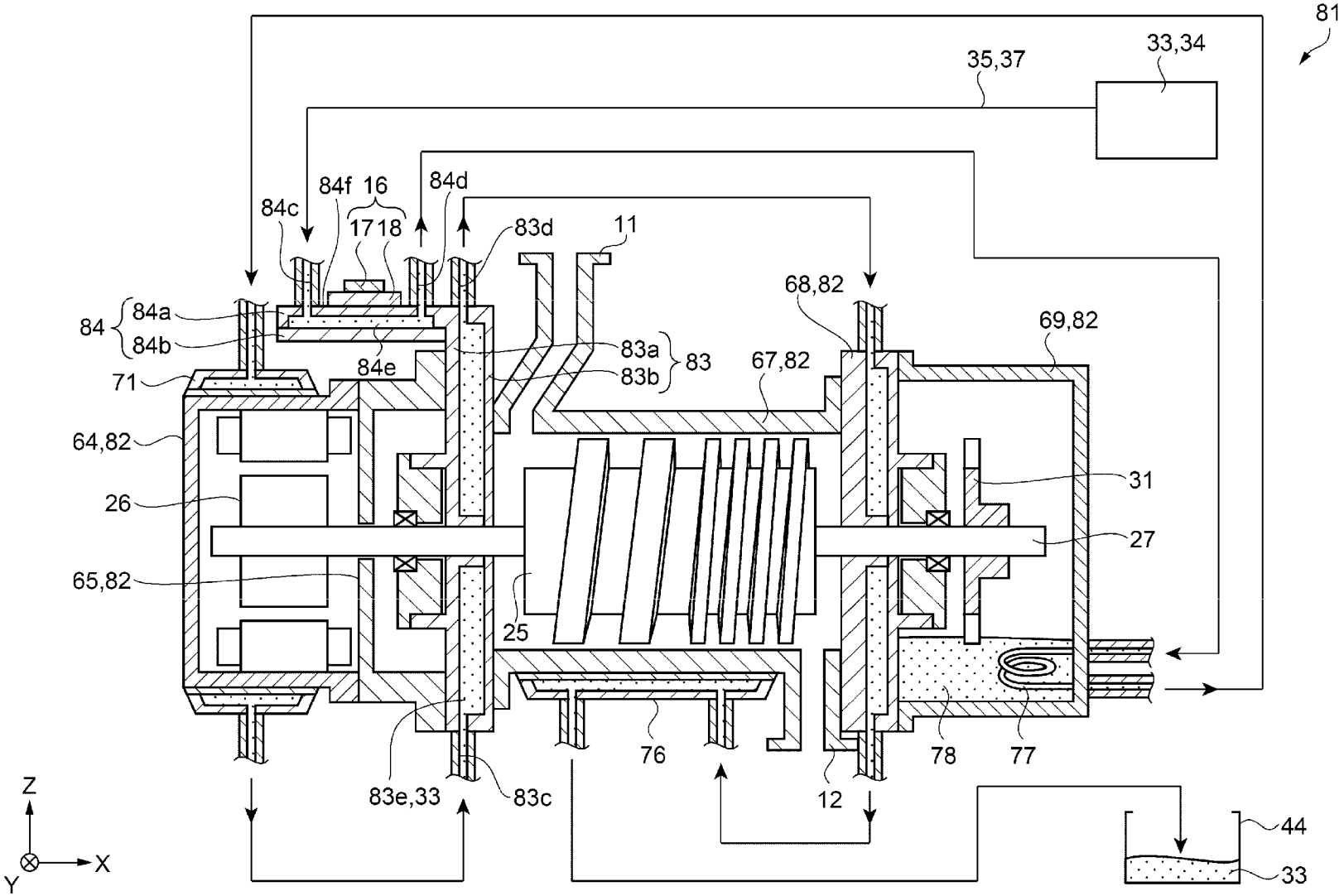
FIG. 16 is a schematic side sectional view showing the configuration of a vacuum pump according to a seventh embodiment.

A seventh embodiment is different from the sixth embodiment in that the monitoring device 16 is set on the first sidewall 66. As shown in FIG. 16, a vacuum pump 81 functioning as a device includes a housing 82. The housing 82 includes the motor case 64, the connecting section 65, the first sidewall 83, the pump case 67, the second sidewall 68, and the gear case 69. The components other than the first sidewall 83 are the same as the components in the sixth embodiment. Besides, the vacuum pump 81 includes the pump cooling section 76 and the cooling pipe 77 same as those in the sixth embodiment.

The first sidewall 83 includes a first side plate 83*a* and a second side plate 83*b*. The first side plate 83*a* includes a recess on the second side plate 83*b* side. The first side plate 83*a* and the second side plate 83*b* are joined. The recess is formed as a second hollow 83*e*.

The first side plate 83*a* includes a second water inlet port 83*c* and a second water outlet port 83*d*. The second water inlet port 83*c* and the second water outlet port 83*d* communicate with the second hollow 83*e*. The water 33 is filled in the second hollow 83*e*. Heat of the motors 26 and the pump rotors 25 are absorbed by the water 33 in the second hollow 83*e*. The water 33 supplied from the second water inlet port 83*c* absorbs the heat and is discharged from the second water outlet port 83*d*. As a result, the motors 26 and the pump rotors 25 are cooled.

Figure 17:
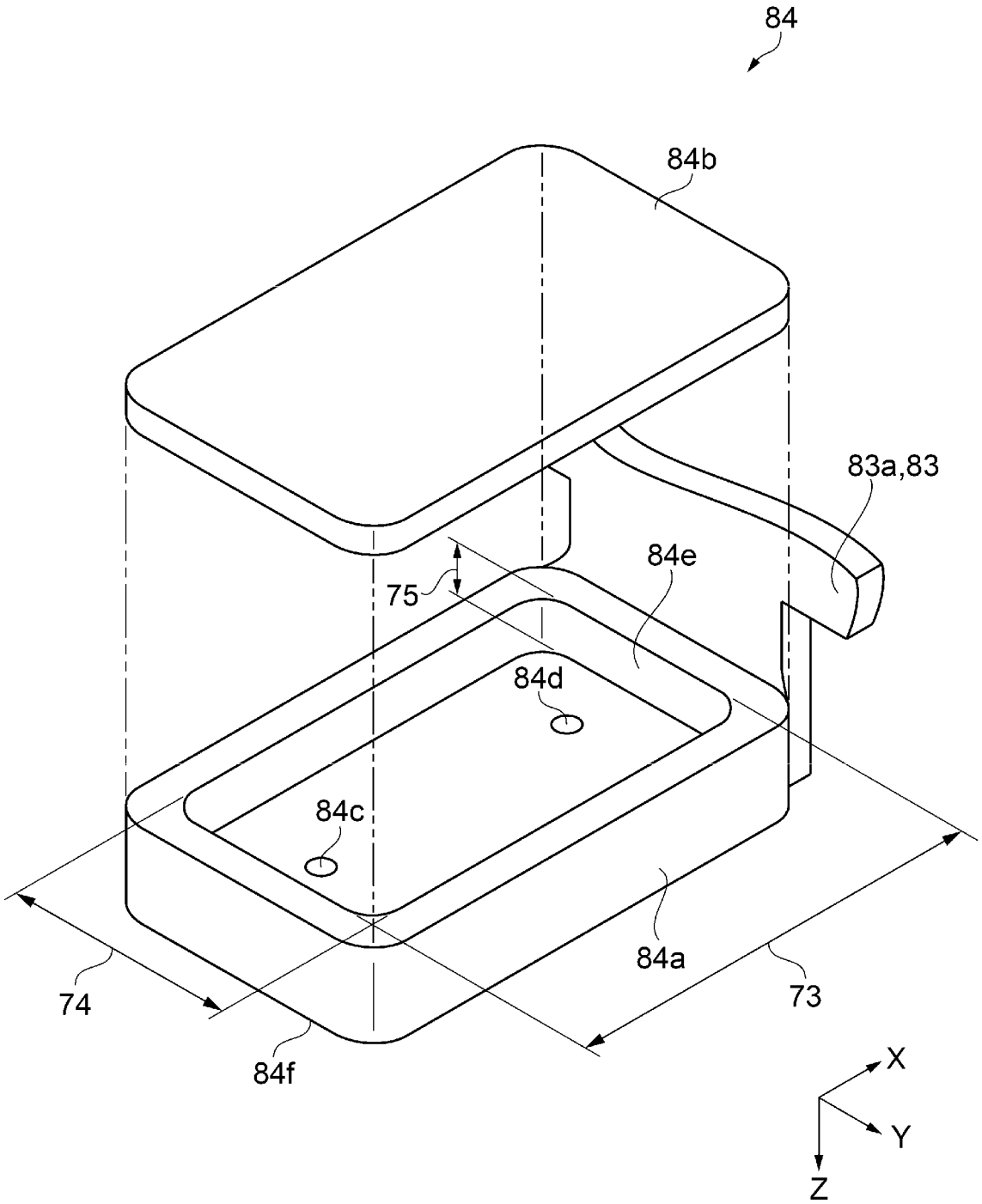
FIG. 17 is a schematic perspective view showing the configuration of a sensor cooling section.

The first sidewall 83 is longer on the +Z-direction side than the first sidewall 66 in the sixth embodiment. On the +Z-direction side of the first sidewall 83, a sensor cooling section 84 is set on the −X-direction side. As shown in FIGS. 16 and 17, a side surface of a third top plate 84*a* is fixed in contact with the first side plate 83*a*. Vibration of the first side plate 83*a* is conducted to the monitoring device 16 via the sensor cooling section 84.

The sensor cooling section 84 includes the third top plate 84*a* and a third bottom plate 84*b*. The third top plate 84*a* includes a recess on the third bottom plate 84*b* side. The third top plate 84*a* and the third bottom plate 84*b* are joined. The recess is formed as a third hollow 84*e* functioning as a first channel.

The third top plate 84*a* includes a third water inlet port 84*c* and a third water outlet port 84*d*. The third water inlet port 84*c* and the third water outlet port 84*d* communicate with the third hollow 84*e*. The water 33 is filled in the third hollow 84*e*. Heat transferred from the first sidewall 83 is absorbed by the water 33 in the third hollow 84*e*. The water 33 supplied from the third water inlet port 84*c* absorbs the heat and is discharged from the third water outlet port 84*d*. As a result, the temperature of the monitoring device 16 is maintained.

The surface on the +Z-direction side of the sensor cooling section 84 is an attachment surface 84*f* for the monitoring device 16. The monitoring device 16 is attached to the attachment surface 84*f*. The length in the X direction of the third hollow 84*e* is the first length 73. The length in the Y direction of the third hollow 84*e* is the second length 74. The first length 73 and the second length 74 are lengths in a direction parallel to the attachment surface 84*f*. The third length 75 is the length in the Z direction of the third hollow 84*e*. The third length 75 is the length of the third hollow 84*e* in a direction perpendicular to the attachment surface 84*f*. The first length 73 and the second length 74 are larger than the third length 75. Therefore, the length of a sectional shape of the third hollow 84*e* in the direction parallel to the attachment surface 84*f* for the monitoring device 16 is larger than the length in the direction perpendicular to the attachment surface 84*f* for the monitoring device 16.

With this configuration, a channel by the third hollow 84*e* can be easily manufactured compared with the first channel 21 in the first embodiment. Since the channel is wider and shorter, fluid resistance can be set smaller compared with the first channel 21 in the first embodiment.

The housing 82 includes the third hollow 84*e* for causing the water 33 to flow to overlap the monitoring device 16 in a plan view from the direction perpendicular to the attachment surface 84*f* of the monitoring device 16.

The water source 34 and the third water inlet port 84*c* are coupled by the supply pipe 35. The water 33 supplied from the water source 34 passes through the supply channel 37, the sensor cooling section 84, the cooling pipe 77, the motor cooling section 71, the first sidewall 83, the second sidewall 68, and the pump cooling section 76 in this order and is discharged to the drainage channel 44.

What is claimed is:

1. A device comprising:

a movable body;

a housing configured to house the movable body; and a monitoring device attached to the housing and configured to detect vibration of the housing, wherein the housing includes first channels for causing a coolant to flow to overlap the monitoring device in a plan view from a direction perpendicular to an attachment surface for the monitoring device, the housing includes second channels for causing the coolant to flow to a portion opposed to the moveable body, the device further comprises a dividing section configured to divide a supply channel for supplying the coolant into the first channels and the second channels, and the first channels have higher density than the second channels.

2. The device according to claim 1, wherein the supply channel for supplying the coolant, the first channels, and the second channels are coupled in series in this order.

3. The device according to claim 1, wherein a channel sectional area of the first channels and a channel sectional area of the second channels are same, and a number of the first channels included in a predetermined area when viewed from a direction in which the coolant flows is larger than a number of the second channels.

4. The device according to claim 1, wherein the coolant is water.

5. A device comprising:

a movable body;

a housing configured to house the movable body; and a monitoring device attached to the housing and configured to detect vibration of the housing, wherein the housing includes first channels for causing a coolant to flow to overlap the monitoring device in a plan view from a direction perpendicular to an attachment surface for the monitoring device, and a length of a sectional shape of the first channels in a direction parallel to the attachment surface for the monitoring device is larger than a length in the direction perpendicular to the attachment surface for the monitoring device.

* * * * *